United States Patent [19]

Ribesse

[11] Patent Number: 4,813,179

[45] Date of Patent: Mar. 21, 1989

[54] PROCESS FOR THE COCURRENT GASIFICATION OF COAL

[75] Inventor: Jacques Ribesse, Brussels, Belgium

[73] Assignee: Distrigaz S.A., Brussels, Belgium

[21] Appl. No.: 33,094

[22] Filed: Mar. 31, 1987

[30] Foreign Application Priority Data

Apr. 1, 1986 [FR] France ..... 8604599

[51] Int. Cl.[4] ..... C10J 3/06

[52] U.S. Cl. ..... 48/210; 48/87; 48/128; 414/213; 414/216

[58] Field of Search ..... 48/202, 206, 210, 128, 48/63, 77, 87, 207, 203, 76; 252/373; 110/165 R, 229, 259; 414/209, 213, 216

[56] References Cited

U.S. PATENT DOCUMENTS

| | | | |
|---|---|---|---|
| B 375,220 | 1/1975 | Fernandes | 48/197 R |
| 1,020,651 | 3/1912 | Lorin | 48/63 |
| 1,505,065 | 8/1924 | West et al. | 48/206 |
| 2,558,746 | 7/1951 | Gaucher | 48/206 |
| 3,746,521 | 7/1973 | Giddings | 48/206 |
| 3,870,480 | 3/1975 | Moss | 48/128 |
| 3,920,417 | 11/1975 | Fernandes | 48/197 R |
| 4,286,970 | 9/1981 | Cankurt | 48/128 |
| 4,302,353 | 11/1981 | Escher et al. | 252/373 |
| 4,388,082 | 6/1983 | Guttmann et al. | 48/77 |

FOREIGN PATENT DOCUMENTS

| | | | |
|---|---|---|---|
| 089329 | 9/1983 | Belgium . | |
| 54995 | 1/1891 | Fed. Rep. of Germany . | |
| 1048658 | 7/1959 | Fed. Rep. of Germany . | |
| 2390495 | 12/1978 | France . | |
| 2407256 | 5/1979 | France . | |
| 2054112 | 2/1981 | United Kingdom | 48/111 |

*Primary Examiner*—David L. Lacey
*Assistant Examiner*—Joye L. Woodard
*Attorney, Agent, or Firm*—Christie, Parker & Hale

[57] ABSTRACT

The invention relates to the cocurrent gasification of coal and to a gas generator. The gas generator (11) comprises a vertical sealed vessel, the lower third of which is divided into several identical vertical compartments (12). Coal is loaded at the top (17). The major part of the hot reactive gas under pressure is introduced at the top (18), and the remaining part at lower levels (21, 22). Gas evacuation (24) is stopped from one compartment (12) in turn, gas produced is blown in order to unclog the filters (25, 26) and to loosen the ash, the ash is extracted at the bottom (23) and cold reactive gas is blown countercurrently in order to complete the combustion and to cool the ash. This gas generator enables coal from any source to be used and does not require purification downstream.

10 Claims, 6 Drawing Sheets

14
15
19
20
16
18
71
69
70
39
38
72
118
40
11
17
73
31
30
21
44
64
29
28
56
55
121
122
22
41
42
43
24
12
23
32
33
54
53
59
60
63
62
61

PROCESS FOR THE COCURRENT GASIFICATION OF COAL

BACKGROUND OF THE INVENTION

1. Field of the Invention

The present invention relates to a process and to an apparatus for the gasification of coal by supplying coal and reactive gas to the top of the reactor, the gas and solid flows moving downwards cocurrently over most of the reactor, and completing the reaction by the countercurrent introduction of a quantity of reactive gas at the base of the reactor. The reaction takes place in fixed bed, under pressure and with unfused ash.

In the present specification, the term "coal" refers to any carbonated substance with a wide range of particle sizes, without having to resort to an upstream preparation of coal, such as, crushing, grinding, sieving and the like. Moreover, the coal may be of any composition, without having to resort to an equipment downstream for the purification or the recovery of byproducts (sulphur-containing compounds, tars, phenols and liquid hydrocarbons). The process of the invention enables all harmful quantities of by-products to be removed or converted "in situ" during the gasification.

In the present specification, the term "fixed bed" refers to a non-turbulent bed which only undergoes a slow downward movement under the influence of gravity.

2. Description of the Prior Art

Most low-pressure or high-pressure fixed bed coal gasification processes used on an industrial scale are countercurrent systems.

A good representative example is the LURGI process, the gas generator of which is shown in FIG. 1. In the LURGI process, size-graded coal with low caking capacity is introduced at the top of the reactor, from there it moves downwards in fixed bed under the influence of gravity and ash is extracted at the base. Steam and oxygen are introduced at the base of the reactor and they are allowed to rise countercurrently and the gases produced are evacuated at the top of the reactor.

This countercurrent process has the advantage of providing a fairly good heat recovery from the gases resulting from the reaction, by giving up a part of the heat to fresh batches of material charged into the furnace. Additionally, because of the countercurrent circulation of fresh oxidizing gas, the reaction is more or less complete. Therefore, there is a minimum loss of active substance in the ash.

On the other hand, given that the hearth of the reaction is at the bottom of the reactor and that the temperature decreases with height towards a point where there is fresh coal, there is a region where the temperature is in the vicinity of 500° C. and where a slow increase in the temperature promotes the formation of a liquid phase which causes the caking of coal particles preventing a regular downward movement of ash. In order to avoid this caking, the LURGI process requires the choice of coal with low caking capacity upstream. Additionally, within the gas generator itself, it was necessary in the LURGI process, to provide a mixing arm to stir up the fixed bed of coal.

If the size of coal is not uniform, an irregular distribution of gases takes place, because of which there is a need for the choice of a size-graded coal (for example, having a particle size between 10 and 30 mm) and for an outfit for sieving and evacuating the fine particles upstream.

The hearth of the reaction is situated at the bottom of the reactor. In order to prevent the temperature there from rising too high, the grid for distributing the oxidizing gas must be cooled by using a large excess of steam, which results in a negative effect on the energy balance and profitability.

The decreasing temperature gradient in the reactor causes by-products to be evolved gradually and to be mixed with the gas produced and 70 to 95% of the sulphur contained in the coal may thus be found in the form of sulphur-containing gaseous compounds in the gas evacuated at the top of the reactor. Therefore, this gas necessitates a purification outfit downstream which must not only remove the sulphur compounds, but also other hindering non-gaseous products such as tars, liquid hydrocarbons, ammonia and the like, from the gas produced.

U.S. Pat. No. 3,920,417 describes a gas generator in which coal and reactor gas descend cocurrently into the lower part of the reactor. In contrast, the upper part of the reactor consists of a region for the countercurrent pre-heating of coal, with a very hot hearth at the base of this region and a temperature which decreases towards the point where fresh coal is present, the fresh coal being introduced at the very top of the reactor. All the disadvantages of the countercurrent process are therefore encountered in this region, i.e. caking and the formation of tars and sulphur-containing gases. Additionally, this process is limited to the use of non-caking coal of a well defined size, and the tars and other undesirable liquids are reinjected into the reactor by means of a steam injector thereby linking the quantities of steam to those of the tar formed.

The hearth of combustion in the gas generator of this patent produces a very high temperature (approximately 1800° C.). In fact, it is desired to produce fused ash there, but, as the steam is introduced downstream of the oxidizing gas and an endothermic reaction follows therefrom, there is every reason to fear that the liquid ash generated upstream becomes cooled, inevitably causing the solidification of the ash, the formation of large-sized clinkers and the blockage of the reactor. Moreover, brick baffles which serve as filters for the liquid ash in the process of solidification will soon be clogged and gas cannot pass uniformly through the reactor towards its point of evacuation. Finally, as the gas generator does not contain a lock, it cannot be operated under pressure.

German Pat. No. 54,995 describes a fixed gas generator in which coal and the major part of the reactor gas are introduced through the open top of the gas generator and descend cocurrently in the latter. In order to avoid caking, additional quantities of air, steam and coal are injected at other lower levels. The gases produced are extracted with a gas suction extractor and therefore, under reduced pressure. This gas generator which is equipped with sliding gates, a water trap and poker holes for removing blocked clinkers cannot operate under pressure. This patent describes the possibility of heating the air with overheated steam, but the risk of caking implies that the temperature of the gas remains below 500° C. Therefore, this gas generator does not provide means which prevent the clinkers from binding together and the coal from caking. On the other hand, the process of this patent, in which a final countercurrent reaction phase is not provided for, clears, with the ash, residual amounts of carbon, which represent a loss or require recycling.

French Pat. No. 783 087 describes a wood gas generator for vehicles with OTTO engines. The combustion therein takes place in a fixed bed and cocurrently. The hearth is divided into several compartments for a better distribution of air injection nozzles and for a loosening of the incandescent bed. In addition to compartmentation of the hearth, the specification of this patent emphasizes the compartmentation of the upper part of the gas generator into several chambers (claim 10), one above the other, at least one of which comprises a drying region and a distillation region. The distillation region produces tars and other undesirable liquid products which must be recycled to ensure their removal, which remains partial, this being a major disadvantage. Additionally, the process of the French Patent can only be carried out at very low pressure (1.5 bar), does not comprise a lock, does not include any continuous ash extraction device and must therefore be interrupted regularly in order to clear the ash and to be cleaned before introducing a fresh charge. Being designed for using wood, if the wood had to be replaced with coal, the caking of the latter in the drying region would be inevitable, as there is no provision for preventing this from occurring.

German patent No. 1 048 658 describes six reactors which operate cocurrently with dry ash and which make use of coal of fine particle size. In each reactor, the coal is fluidized in turn by countercurrent blowing, across the incandescent bed, with a view to bringing about a separation of particles by gravity, so as to direct the ash downward. The blowing is preceded and followed by a blowing of steam above the bed in order to remove oxygen and prevent explosive mixtures from being formed. This blowing is carried out in all the gas generators simultaneously.

U.S. Pat. No. 1,505,065 describes a gasification of soft coal with a view to producing a gas which has a low calorific value, a high hydrogen content and as low a carbon monoxide content as possible. The gas generator comprises two regions: an upper carbonization region and a lower production region. In the carbonization region, coal is loaded at the top and flows downwards. The reactive gas (air+excess steam) is mainly introduced between the two regions, so that it produces an incandescent hearth in the middle of the gas generator and the reactive gas rises in part countercurrently in the carbonization region, gradually heating the fixed bed of coal above and another part of this gas moves down cocurrently with the incandescent coal. Injection of additional amounts of reactive gas is provided for in this lower production region. Given that this process comprises an upper region which is heated gradually, it is not suitable for caking coals. It cannot operate under pressure, as the ash and the dusts are cleared laterally. It cannot prevent ash from being carried away in the gases towards stackings which will clog rapidly; cleaning them is difficult.

European Patent application No. 0,089,329 describes a process for coal gasification under pressure, but it comprises two reactors which operate alternatingly, one at a time. This process has several disadvantages. As it has two reactors and many valves, it is much more expensive to implement and difficult to use. As only one reactor is used at a time, it requires a sweeping with steam after each cyle, that is, every 2 to 4 minutes, in order to separate the reactive gases; that is, air or oxygen and steam and the combustible gases of reaction by purging the plant. Cyclic reversal and constant fluctuations in temperature make the refractories become fragile, making it necessary to replace them more frequently. Finally, the heat contained in the gases produced must necessarily be recovered in this case, which does not allow the hot gases leaving the gas generator to be used directly, as, for example, in the synthesis or in the production of the reducing gas in the steel industry, without using an independent and expensive heating device.

SUMMARY OF THE INVENTION

In order to remedy all the disadvantages of these known processes, the Applicants have developed a fixed bed process for the gasification of coal, by reacting with a reactive gas under pressure, in which the coal is loaded into an upper loading region of a vertical gas generator at a point near the top, from where it flows downwards under the influence of gravity, characterized in that soon after its introduction into the gas generator, it is subjected to a thermal shock by making it react with reactive gases, at a temperature much greater than the caking temperature of coal and close to the fusion temperature of ash and under a pressure of a least 2 bars (0.2 MPa), the major part of the said reactive gases being introduced into the gas separator at a first level close to the point of introduction of coal and, additionally, at at least one level below the said first level, the gases moving downwards cocurrently with the coal, a certain quantity of cold reactive gas being introduced in the evacuation region at the base of the gas generator, at the point of extraction of ash, from where this quantity moves upwards countercurrently to complete the gasification of the residual carbon and to cool the ash, and in that the gas produced by the gasification is evacuated, after filtering, from the evacuation region at a level above the point of ash extraction.

According to a preferred embodiment of the process of the invention, the evacuation region is divided in the direction of flow of the bed into at least three equal compartments and the rate of evacuation of the gas produced is adjusted so as to be identical in all the compartments except one, in turn, in which gas evacuation is stopped. In fact, the evacuation of the gas produced is stopped in one compartment after the other, in turn, and gas produced which is cold and/or steam is (are) blown briefly and vigorously therethrough in a direction opposite to that of evacuation in order to clean the filter and to loosen the ash upstream of the filter in the said compartment. During the stoppage of gas evacuation, a defined quantity of ash, which is identical for all compartments, is evacuated from the base of the compartment concerned, and at the same time, fresh reactive gas is blown into the opening for ash extraction in order to complete the gasification of the residual carbon and to cool the ash.

After holding the coal temporarily in a sealed lock as defined above, it is loaded into a loading region located near the top of a vertical gas generator. The coal is distributed uniformly on the fixed bed and it is allowed to flow downwards under the influence of gravity.

If the coal contains a significant amount of sulphur-containing products, it is mixed with a calcium-or magnesium-containing substance, either before introducing into the coal lock, or through a separate lock before the coal is dispersed.

Depending on the type of gas desired to be obtained at the end of gasification, the reactive gas is air or oxygen and steam for the production of fuel gas, and hydrogen and oxygen for the production of rich gas, and blast furnace gas and oxygen for the production of reducing gas, or other oxidizing gases.

These reactive gases are pressurized. In fact, the process of gasification under pressure has several advantages over gasification at atmospheric pressure or at low pressure. Given that the quantity of gases produced is well above the quantity of reactive gases introduced, a pressurization of the gases introduced represents a saving in compararison with the pressurization of the gases produced which are large in volume. Moreover, this latter pressurization is necessary for transporting the gases through pipework towards their point of use. Additionally, the higher the pressure, the less expensive the pipework and smaller the diameter required for transporting gas under pressure. Finally, gasification under pressure requires a gas generator volume which is much smaller than gasification at atmospheric pressure, and results therefore in a considerable saving in investment costs. For these reasons, reactive gases are pressurized at least to 2 bars, and up to, for example, 40 bars, before introducing them into the gas generator.

They are heated to high temperature by heat recovery, for example between 600° and 1200° C. The major part of these gases (for example 50 to 75%) is introduced into the loading region of the gas generator at a level close to the point of loading and distribution of coal, preferably at a level above this.

For this reason, as soon as it is introduced into the gas generator, the coal is subjected to a thermal shock, the fine particles ignite spontaneously and the larger pieces burst by cracking into a large number of smaller particles, thus releasing volatile substances, and distillation residues, such as tars and phenols, decompose under the influence of heat and are recovered in the form of useful gas.

The gases formed move downwards cocurrently in the bed of solid substances. As this flow is cocurrent, there is a risk of the reaction being incomplete. For this reason, an additional quantity or additional quantities of reactor gases is (are) introduced at at least one other level below the loading region. For example, a second quantity of reactive gases, 10 to 30%, is introduced at a second point of injection, for example, peripheral, and a further quantity of 0 to 20% at a third point of injection, which may be central.

Because of the secondary and tertiary, etc. injections, the gasification reaction takes place efficiently along the entire height of the solid mass and the temperature of the reaction medium is maintained at a high level and under control.

The thermal shock of the first injection and the continuation of the reaction by the other injections disaggregate the coal without caking it, regardless of its composition.

As mentioned above, the preferred embodiment of the process of the invention provides for the division, in the direction of flow of the bed, of the evacuation region into at least three compartments of identical sizes, preferably into four to eight compartments, for example, six equal compartments.

Each compartment is provided with an opening for the evacuation of the gas produced and an opening for the clearing of ash. These evacuations are carried out at a controlled rate. The rate of evacuation of gas is adjusted so as to be identical for all compartments except for one of them, in which, gas evacuation is stopped periodically. In fact, the evacuation of the gas produced is stopped, in turn, in one compartment after the other. When gas evacuation from the compartment concerned is stopped a blast of cold gas produced and/or steam is blown through it under pressure in a direction opposite to the usual direction of evacuation. This blasting serves to clean and to unclog the filter(s) and to loosen the ash beyond the filter in the compartment which is inoperative.

After blowing the gas, a defined quantity of ash is evacuated. This quantity will be the same for all the compartments put out of use in turn.

The distribution of the material in the bed moving downwards into equal compartments and the dual control of the gas and ash evacuation rates ensure a uniform downward movement, at all points, of the whole of the fixed bed, in spite of a variable particle size of the coal used at the start, without having to resort to the use of a mixing arm, which is expensive and difficult to operate at the high temperatures of gas generators.

As the ash is cleared from one compartment at a time and as this ash remains stationary in the other compartments, the clogging of filters during the evacuation of gases from the latter is reduced to the minimum, the mass of ash forming mass-filter.

During ash clearing, cold reactive gas is injected into the opening for ash flow, at the base of the compartment. The purpose of this injection is, firstly, to gasify the residual carbon contained in the ash and, secondly, to cool the ash completely before clearing it, with the total recovery of the substantial heat in the reactor. For this reason, the coal is entirely gasified in a single step, in a single gas generator and no recycling of ash is required. The gas evacuated from each compartment at a uniform rate is combined in a common receiver and leaves the gas generator at high temperature. It can then give up its substantial heat to the reactive gases in heat exchangers and produce the steam required for the reactions in a recovery boiler and then pass into a scrubber in which the impurities which may be present are removed, or may be used directly by a consumer, as such, at high temperature, or heated in independent heaters.

In fact, the gas produced by the process according to the invention does not require any downstream purification outfit, as the undesirable products: tars, liquid hydrocarbons, phenols and sulphur-containing compounds are either decomposed by the initial thermal shock, or react with the calcium-containing substance and are removed with the ash.

As briefly mentioned above, in order to remove the sulphur-containing compounds in the gas produced, especially when sulphur-rich coal is used in the process of the invention, the addition of a defined quantity of calcium- or magnesium- containing substances, for example, chalk, is provided for. This, addition may be carried out at the same time as the coal, or separately. More than 90% of the sulphur-containing compounds are thus fixed in a solid form in combination with the ash and the gas leaving the gas generator is free from by-products and other components wich are harmful at the time of use. Therefore, in most cases of use, there is no need to install gas purification equipment.

The present invention also relates to apparatus suitable for implementing the process described above, a gas generator in this case.

The coal gasification apparatus according to the invention comprises, in combination, a sealed vertical vessel, the lower part of which is divided into at least three compartments of equal size by means of radial vertical partitions, leaving the tops of these compartments in communication with the undivided upper part of the vessel, the vessel being provided:

with a sealed coal loading means near the top of the vessel and a means for its distribution on the fixed bed, with a means for the introduction of most of the hot reactive gas, at a first level, close to the point of introduction of coal into the vessel enclosure, with at least one means for the introduction of an additional quantity of reactive gas at at least one level below the said first level, with a means for the removal of a controlled quantity of ash from the bottom of each compartment, a common and sealed means for collecting and clearing the ash and a means for the introduction in each compartment of a final part of the reactive gas into the means for the extraction of ash, with a means for the evacuation of the gas produced from each compartment, which means is located at a level above that for ash extraction, with a means for filtering the gas, with a means for adjusting the gas flowrate and for stopping its evacuation, with a means for the countercurrent introduction of the cold gas produced when the evacuation is stopped, the different means for gas evacuation, one per compartment being connected to a common receiving means.

The gas generator advantageously comprises four to eight equal compartments. These compartments preferably occupy 20 to 40% of the total height of the gas generator.

The sealed coal loading means is advantageously a lock, from which the coal is brought towards the distributor by means of a dispensing device, for example, a lifting screw.

The main reactive gas introducing means is preferably located at a level above the level of coal distribution on the fixed bed and it is advantageously peripheral around a central means for the distribution of coal.

The additional means for the introduction of the reactive gas preferably comprises a peripheral means located approximately half way up the height of the gas generator and a central means in the middle and at the top of the section divided into compartments.

The means for this extraction of ash from each compartment preferably comprises a means for grinding the clinkers when they are present.

The means for filtering the gas produced preferably comprises a filter wit large poresize, for example, 3 mm, and a special filter made of metallic or ceramic refractory material which holds back fine particles of dust, for example, 0.1 mm and above.

The means for evacuating the gas produced is preferably a tuyere, one per compartment, equipped with a flow adjustment and stopping device and an opening for the countercurrent introduction of the cold gas produced when gas evacuation is stopped, the different tuyeres being combined downstream of the adjusting means into a peripheral common receiving means.

The gas generator is preferably equipped with a means for the addition of calcium- or magnesium-containing substance to the coal. This means comprises the addition of the calcium- or magnesium-containing substance to the coal before introducing it into the sealed loading means (lock), or alternatively, a separate lock, the two solid charges being mixed with each other at the top center in the means for distribution and for homogenous scattering, for example, a scattering disc.

BRIEF DESCRIPTION OF THE DRAWINGS

Using the figures attached, in which same numbers refer to the same parts, an example of one embodiment of the gas generator according to the invention and some block diagrams for the manufacture illustrating the use and the operation of the gas generator of the invention are described.

DETAILED DESCRIPTION OF THE INVENTION

Figure 1:
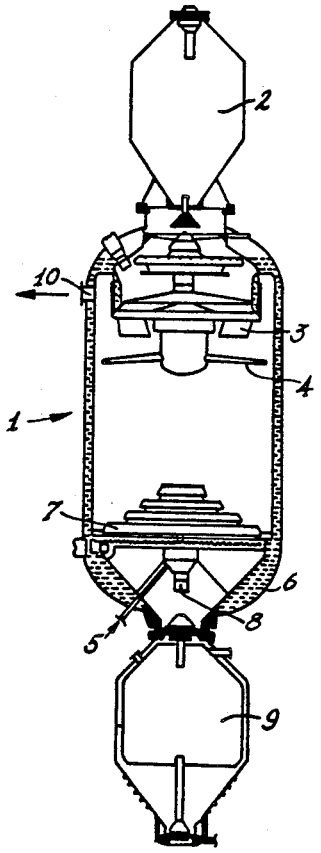
Fig. 1 (PRIOR ART)
FIG. 1 is a diagram of a known gas generator according to the LURGI countercurrent process.

FIG. 1 is a diagram of a known LURGI gas generator in countercurrent operation under pressure.

Generator 1 comprises at its top a lock 2 for loading size-graded coal which flows downwards, in fixed bed, and which is distributed by the distributor 3. A mixing and crushing rotary arm 4 stirs the fixed bed and prevents it from caking. The reactive gas (oxygen+steam) is introduced at 5 at the base of the generator 1 and moves upwards countercurrent to the flow of coal. Around this point of introduction 5 of reactive gas, the gas generator is equipped with a water-cooled jacket 6. The countercurrent reaction removes combustible substances from the coal and converts it into ash which is cleared through the rotary grid 7 and the opening 8 at the bottom of the generator 1 towards the sealed ash lock 9. The gas produced is evacuted from the top of the generator 1 through the opening 10.

Figure 2:
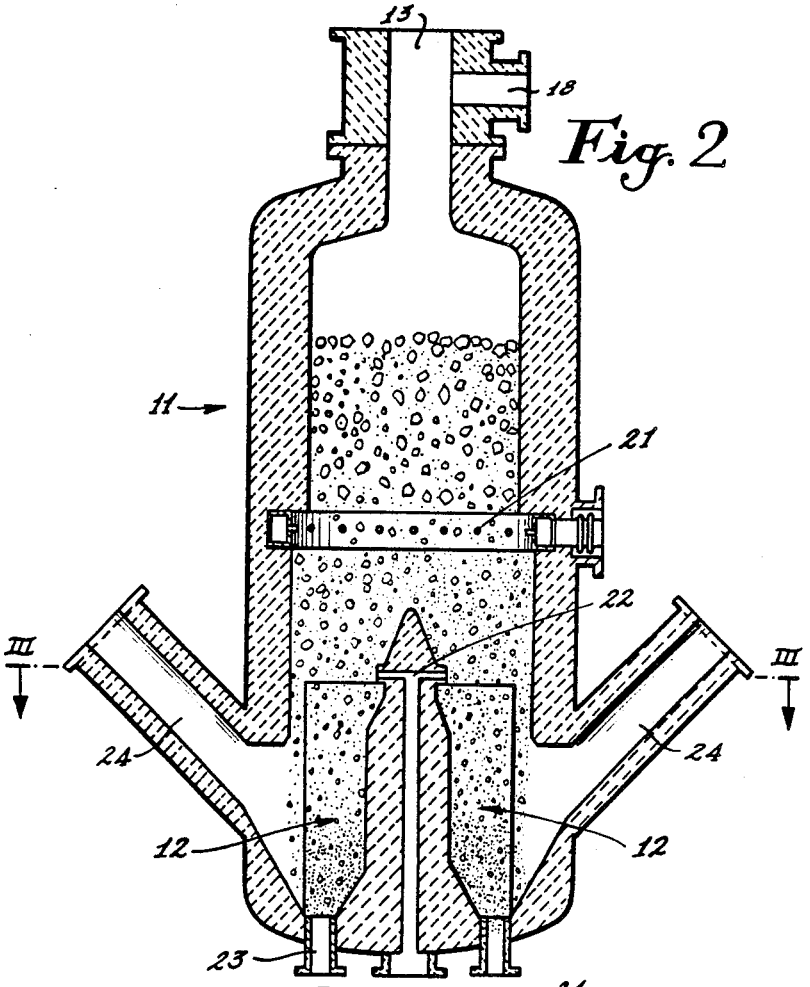
FIG. 2 is a vertical cross-section of a coal gasification apparatus according to the invention.
Figure 5:
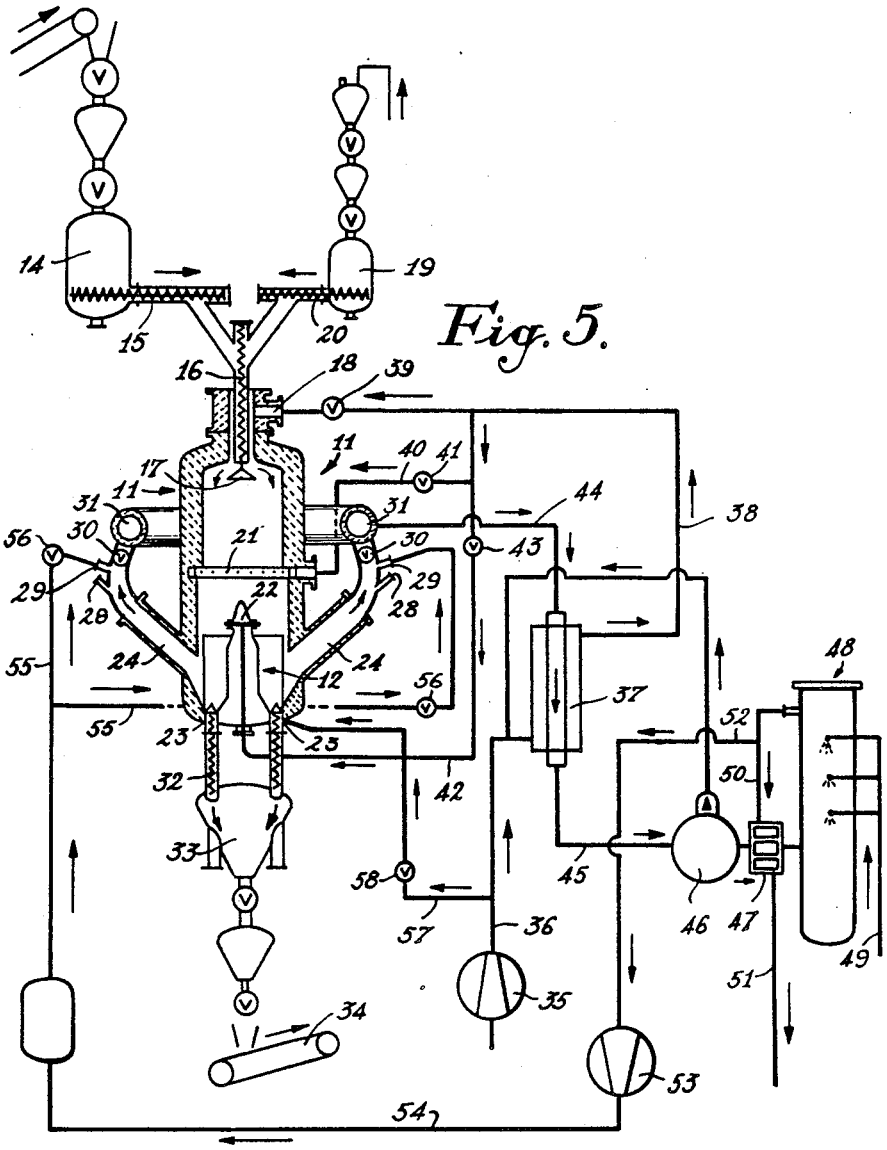
FIG. 5 is a block diagram for the manufacture of fuel gas by the process and the apparatus of the invention.

FIG. 2 shows a vertical cross-section of a coal gasification apparatus according to the invention. It comprises a vertical reactor 11, the lower part of which is divided into six vertical compartments 12 of identical size (cf. FIG. 3). The gas generator 11 is provided with an opening 13 for loading coal at its top. The coal is in a sealed lock 14 (cf. FIG. 5), from where it is loaded by the dispensing device 15 in the form of a lifting screw towards a vertical distributor 16 which scatters it with the scattering device 17 on the fixed bed of coal. Thus, this scattering device 17 is at the top center of the enlarged cavity of the reactor 11. The major part of the reactive gas, for example 60%, is introduced through the opening 18, located at a level above that of the scattering device 17, because of which the gas surrounds the distributor 16 and the scattering device 17. This reactive gas is heated beforehand to a temperature of 600° to 1200° C. by heat recovery or by heating. The coal scattered at the center by the scattering device 17 is therefore directly subjected to an intense thermal shock resulting from the reaction. The fine particles ignite spontaneously and the larger pieces burst with cracking into a large number of smaller particles which drop onto the fixed bed, having released volatile substances and distillation residues (tars and phenols). These products decompose in situ under the influence of heat and are converted into useful gas. When the coal used contains a significant amount of sulphur-containing product, a calcium- or magnesium-containing substance, for example calcium carbonate, is loaded into the reactor at the same time as the coal. This may be carried out in two ways: either the calcium- or magnesium-containing substance is mixed with the coal in the same lock, or this substance is loaded into a separate sealed lock 19, as shown in FIG. 5, and the calcium- or magnesium-containing substance is brought, through a separate dispensing device 20, towards the vertical central distributor 16 from which it is scattered at 17 at the same time as the coal. As the gas and solid (coal+calcium- or magnesium-containing substance) flow move cocurrently, the calcium- or magnesium-containing substance reacts with the sulphur to finally for calcium sulphate (or magnesium sulphate) which is cleared with the ash. Thus, the gas produced is also freed from any sulphur-containing substance and it no longer requires a treatment or recovery outfit downstream. The coal, and the calcium- or magnesium-containing substance when present, and the reactive gas move downards cocurrently in the reactor. In order to ensure a good reaction of all the active substance in the coal, an additional quantity of hot reactive gas, for example, 25%, is introduced halfway up the height of the reactor 11, through the peripheral openings 21. It is preferable to introduce a further final quantity of hot reactive gas, for example 15%, through a center opening 22 at the top center of the part of the reactor which is divided into compartments. All these quantities of reactive gas move downwards cocurrently with the coal.

Finally, in order to complete the reaction of the residual carbon in the ash, a certain quantity of cold reactive gas is injected, countercurrently in this case, into the opening for ash extraction 23. Additionally, this final quantity will ensure the cooling of the ash.

Figure 3:
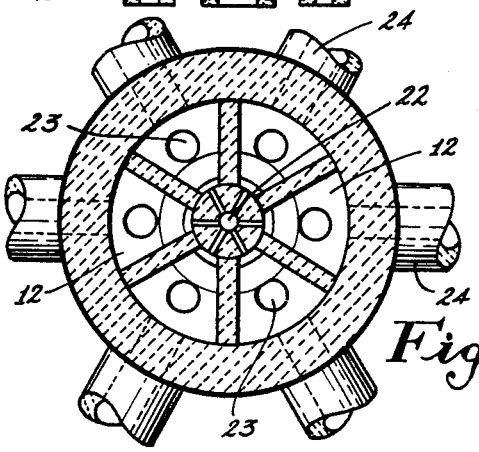
FIG. 3 is a horizontal cross-section along line III—III of the gas coal gasification apparatus in FIG. 2.

As described above, the lower part of the reactor is divided into six vertical compartments of identical size, by means of radial vertical partitions (cf. FIG. 3). Each compartment 12 is in communication with the undivided upper part of the reactor 11. Thus, the fixed bed, which was moving downwards in a single solid mass so far, becomes divided into six equal parts in the six compartments. This division of the fixed bed is an important factor for the homogeneous distribution and uniform downward movement of the mass of coal and ash.

Figure 4:
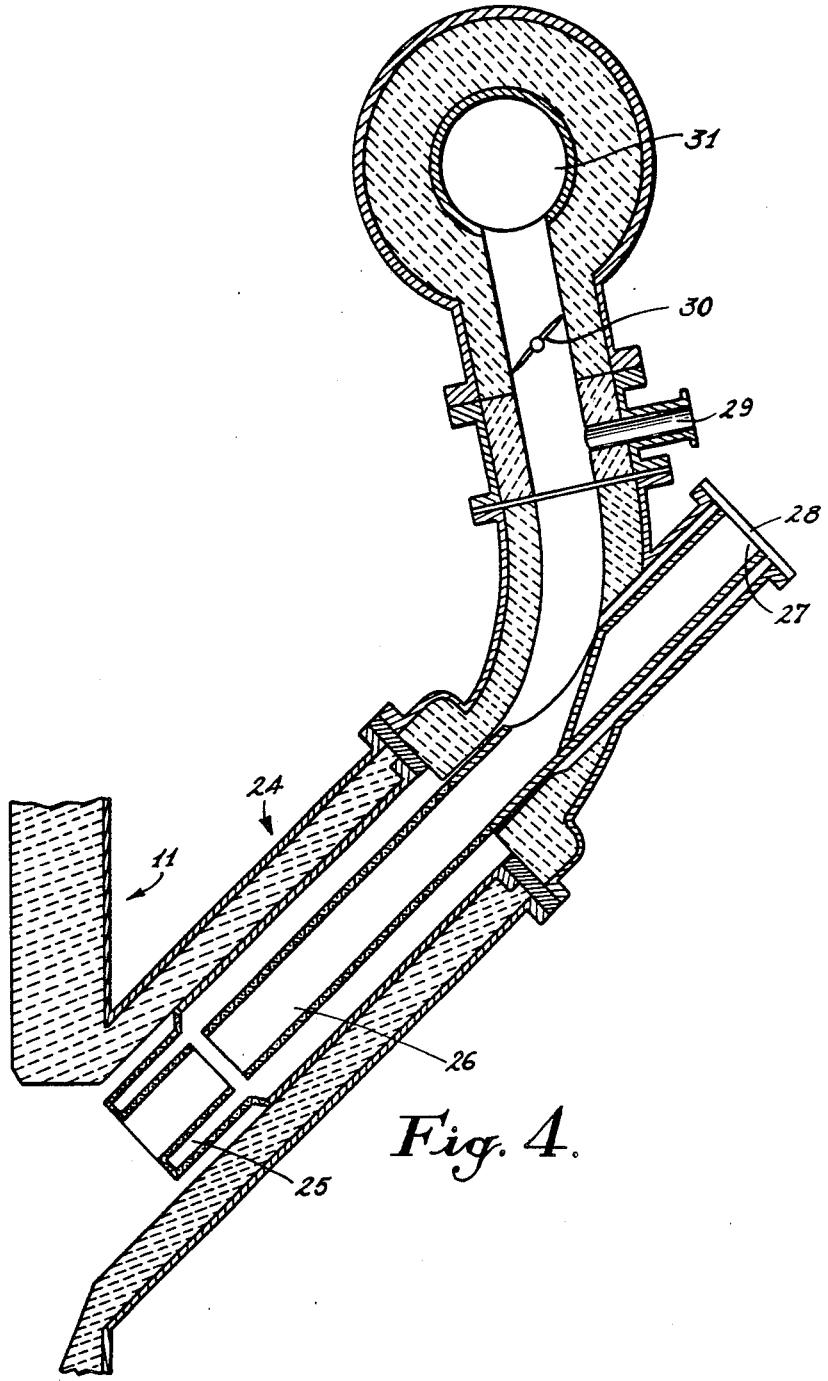
FIG. 4 is a vertical cross-section, on an enlarged scale, of a gas evacuating tuyere.

The mass of coal and ash and the gases are therefore distributed in identical quantities into the six compartments 12, from which their clearing is carried out. The gas produced is evacuated from five of the six compartments 12 by a tuyere 24 (see, more particularly FIG. 4). Each tuyere contains two filters, the first, 25, in the form of a grid with large poresize to retain particles of large size, which have a diameter greater than 3 mm and the other, 26, made of metallic or ceramic refractory material, to retain particles of dust with a diameter between 0.1 mm and 3 mm. In continuation of filters 25 and 26, the tuyere 24 comprises an opening 27 with a plug 28, through which the filter(s) may be introduced or taken out for cleaning or replacement. Elsewhere, the tuyere 24 is equipped with an opening through which a blast of cold gas produced and/or steam is blown vigorously for a short time. The tuyere also comprises a valve 30 which regulates the gas evacuation rate or turns it off. Finally, the six tuyeres open out into a common receiver 31, from which the gas produced leaves the gas generator at high temperature. The point to which it is covered depends on the type of gas produced and its use, as explained in the production block diagrams in FIGS. 5 to 7.

The ash and the residual carbon it contains move downwards homogeneously into the six compartments. Each compartment 12 contains at its bottom an opening 23 for ash extraction. Through this opening, an extractor-grinder 32 (cf. FIG. 5) enters into the compartment, grinds the ash if it is agglomerated and extracts it in a controlled manner towards the common sealed ash lock 33, from which the ash is cleared, for example, with a conveyor belt 34. The opening 23 for clearing ash is provided with a means for the countercurrent introduction of a quantity of cold reactive gas as already described above.

The valves 30 of the tuyeres 24 regulate the gas evacuation rate so that this rate is identical in all the tuyeres except one, in which gas evacuation is stopped. In fact, the evacuation of the gas produced is stopped, in turn, in one compartment after the other, by closing the valve 30. When gas evacuation from compartment 12 concerned is stopped, a short and vigorous countercurrent blast of cold gas produced under pressure and/or steam is blown therein through the opening 29. This blast cleans and unclogs the two filters 25 and 26 of the tuyere 24 concerned and loosens the ash beyond the filter 25 in the compartment 12 concerned.

After blowing the gas, the clearing of a defined quantity of ash is carried out through the opening 23 using the extractor-grinder 32. This quantity will be the same for all the compartments during the stoppage, in turn, of gas evacuation. During ash extraction, a certain quantity of cold reactive gas is introduced through the ash extraction opening 23, and it rises countercurrently and completes the combustion of residual carbon in the ash and cools the latter.

This dual control of the rate of gas evacuation and ash clearing, which shall be identical for all the compartments, ensures a homogeneous distribution and a uniform downward movement of the whole of the fixed bed, distributed into the six compartments, irrespective of the particle size or the composition of the coal used at the start.

As ash is cleared from one compartment 12 at a time and this ash remains stationary, in the meantime, in the other five compartments, the clogging of the filters in the latter is reduced to the minimum and gas evacuation from the five compartments is carried out unhindered.

FIG. 5 shows a block diagram for the manufacture of fuel gas and thus illustrates an example of use and operation of the gas generator of the invention.

Coal is loaded into the sealed lock 14, it is then conveyed by the dispensing device 15 towards the distributor 16 where it joints the calcium-containing substance which was loaded into the lock 19 and conveyed by the device 20 towards the same distributor 16. The coal and the calcium-containing substance mix with each other and are scattered together on the fixed bed by the scattering device 17.

The compressor 35 directs reactive gas, air or oxygen, through the pipe 36, towards the heat exchanger 37. Steam originating from the boiler 46 is introduced therein at the same point. The reactive gases are heated to approximately 700° C. They leave the exchanger through the pipe 38 which divides into three tubes, each provided with its own valve, viz. the continuation of the tube 38, provided with the valve 39, supplies the top of the reactor 11, the tube 40, provided with the valve 41, supplies the middle of the reactor 11 and the tube 42, provided with the valve 43 opens out into the top center of the part divided into compartments. The flowrate through the valves is adjusted so that the major part of the hot reactive gas, for example 60%, is supplied to the top of the reactor through the opening 18, a second part, for example 25%, is supplied to the periphery at half-way up the height of the reactor through the peripheral openings 21 and a third part, for example 15%, is supplied to the center of the part divided into compartments through the opening 22.

As soon as they are introduced into the cavity of the reactor, the coal and the calcium-containing substance scattered by the scattering device 17 are subjected to a thermal shock by reaction with the hot reactive gases and the temperature reaches approximately 1000° C. These gases are introduced through the opening 18 located at a level above that of the scattering device and surrounding the latter. The small particles ignite and the large pieces burst and the whole of the fixed bed and the gaseous flows move downwards slowly and cocurrently.

In contrast to countercurrent processes, this cocurrent downward movement alone cannot ensure en exhaustion of combustible substance from the coal. For this reason, a second quantity of reactive gas is introduced peripherally half-way up the height of the reactor and a third quantity is introduced at the top center of the part divided into compartments.

Ash moves down into the compartments and is cleared towards the common lock 33 and then removed.

The gas produced, fuel gas, leaves the reactor 11 through the tuyeres 24, the flow regulation valves 30, the receiver 31 and the pipe 44 towards the heat exchanger 37. It gives up its heat there to the reactive gas by heat exchange and heats it. The gas produced leaves the heat exchanger 37 through the tube 45, heats the recovery boiler 46 and exchanger 47 and is scrubbed in the scrubber 48 which receives cold water through the pipe 49. The scrubbed and cooled gas passes through the pipe 50 to the exchanger 47 and from there, through the pipe 51 towards the user. A part of this cooled gas leaves the tube 50 through the tube 52 towards the gas compressor 53. The compressed gas at 53 passes through the tube 54 and is divided into six tubes 55, each provided with a valve 56. When gas evacuation is stopped in one compartment at a time, in turn, by closing the valve 30, the corresponding valve 56 is opened and cold gas produced under pressure is blown countercurrently, vigorously for a short time, in order to unclog the filters and to loosen the ash in the compartment concerned.

It should be noted that, after compression but before heating in the heat exchanger 37, a part of the reactive gas is conveyed by the tube 57 provided with its valve 58, towards the opening 23 for ash extraction. During the stoppage of gas evacuation in a given compartment, fresh countercurrent reactive gas is introduced through this tube 57 into the compartment concerned where it completes the combustion of the residual carbon and cools the ash.

Figure 6:
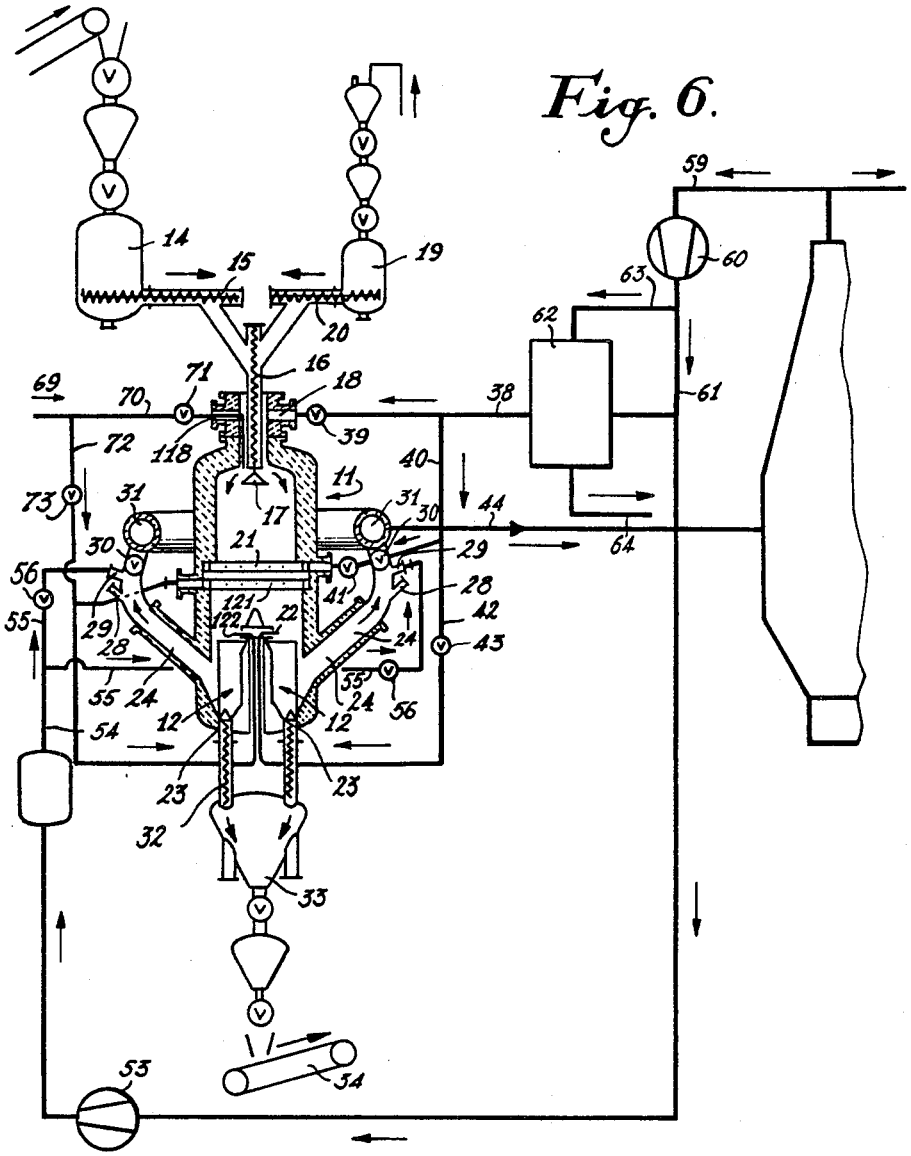
FIG. 6 is a block diagram for the manufacture of reducing gas in substitution for coke in the steel industry by the process and the apparatus of the invention.

FIG. 6 represents a block diagram for the manufacture of reducing gas in substitution for coke in a blast furnace and thus illustrates another example of use and operation of the gas generator of the invention.

In this diagram, the coal and calcium-containing substance loading system and the ash clearing system are identical to those in FIG. 5 and will not therefore be repeated here. Moreover, all the parts which correspond to those in FIG. 5 carry the same number.

The diagram in FIG. 6 differs from that in FIG. 5 mainly by the system for the supply of reactive gas and for the evacuation of the gas produced.

In FIG. 6, a part of the gas produced by the gas furnace (reactive gas) and which essentially consists of CO, $CO_2$ and $N_2$ is directed through the tube 50 towards the compressor 60 and through the tube 61 towards the gas heater 62 which is supplied with fuel gas through the tube 63 and the combustion fumes of which are evacuated at 64. The hot blast furnace gas leaves the heater 62 through the tube 38 which divides into two or three tubes, each provided with its valve for supplying the gas generator. By the continuation of the tube 38 and the valve 39, the major part of this hot reactive gas, for example 60%, is supplied to the top of the reactor through the opening 18 located above the point of scattering of the coal 17. Through the tube 40 and the valve 41, anoter part of the reactive gas, for example 25%, is supplied half-way up the height of the reactor through the peripheral openings 21. Finally, through the tube 42 and the valve 43, a final part of the hot reactive gas, for example 15%, is supplied to the center 22 of the reactor at the top of the part divided into compartments.

As regards oxygen, which is required for the reaction, it is introduced at three points close to the point of introduction of the blast furnace gas, viz. at the top at 118, half-way up the height at 121 and at the center at 122.

The reducing gas produced by the reaction of the blast furnace gas with the coal and which essentially consists of CO, $H_2$ and $N_2$ leaves the compartments 12 through the tuyeres 24, the valves 30, the receiver 31 and the tube 44 and, in its turn, is supplied to the blast furnace in the region of production of the reducing gas. The use of the blast furnace gas in the gas generator and the resupply of the reducing gas to the blast furnace enables the coke consumption to be reduced by up to 50%.

Figure 7:
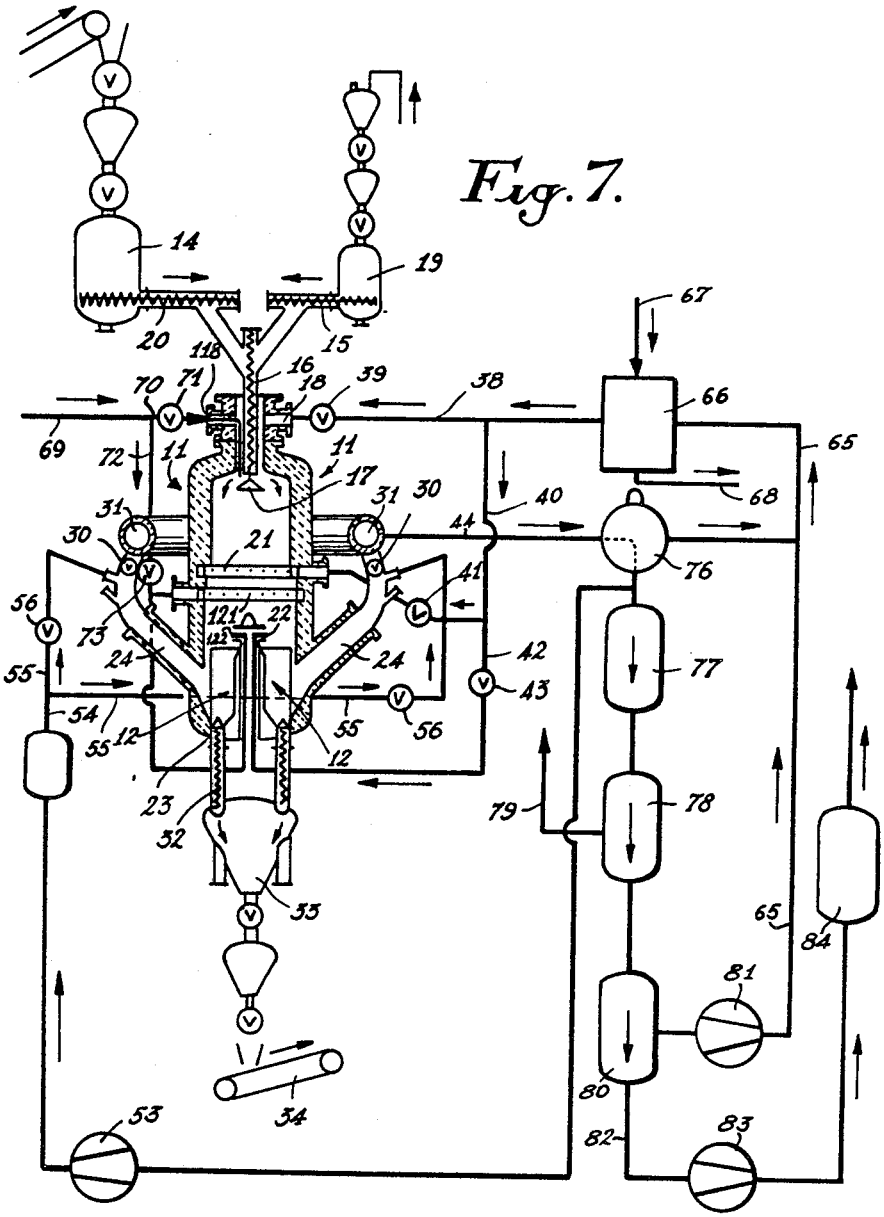
FIG. 7 is a block diagram for the manufacture of substitute natural gas (SNG) by the process and the apparatus of the invention.

FIG. 7 shows a block diagram for the manufacture of Substitute Natural Gas (SNG) and thus illustrates a third example of use and operation of the gas generator of the invention.

In this diagram, the coal and calcium-containing substance loading system and the ash clearing system are identical to those in FIG. 5 and will therefore not be repeated here. Moreover, all the parts which correspond to those in FIG. 5 carry the same number.

The diagram in FIG. 7 essentially differs from FIG. 5 by the system for the supply of reactive gas and the system for the evacuation of the gas produced.

In FIG. 7, hydrogen passes through the tube 65 towards the heater 66, which is supplied with fuel through the pipe 67 and the combustion products of which are evacuated through the pipe 69. Heated hydrogen is supplied to the reactor through the pipe 38 which is divided into three tubes each provided with its valve. By the continuation of the tube 38 and the valve 39, the major part of hydrogen, for example 60%, is supplied to the top of the reactor through the opening 18 located above the coal scattering point 17. Through the pipe 40 and the valve 41, another part of hydrogen, for example 25%, is supplied half-way up the height of the reactor through the peripheral openings 21. Finally, through the tube 42 and the valve 43, a final part of hot hydrogen, for example 15%, is supplied to the center 22 of the reactor at the top of the part divided into compartments.

One the other hand, oxygen passes through the tube 69 which is divided into two or three tubes, each provided with its valve. The tube 70 and its valve 71 supply the major part of the oxygen to the top of the reactor. It is joined with the supply of hot hydrogen through an independent opening 118. A second part of oxygen is supplied half-way up the height of the reactor through the tube 72 and the valve 73 and it joins there with the hot hydrogen through the independent peripheral openings 121. If required, a third part of the oxygen is introduced at the center through an independent opening 122.

The gas produced essentially consists of a mixture of $CH_4$, CO, $H_2$, $CO_2$. It leaves the compartments 12 through the tuyeres 24, the valves 30, the receiver 31 and the tube 44 and is directed to the recovery boiler 76, from where it is directed to the CO converter 77, and the $CO_2$ scrubber 78, from where the $CO_2$ is removed through the tube 79. The $CO_2$-free gas then passes through the hydrogen separator 80, from which a part of the pure hydrogen passes through the compressor 81 and is recycled towards the reactor through the tube 65. The residual gas passes through the tube 82 and the compressor 83 towards the final methanation reactor 84. The gas leaving from there, which mainly consists of methane, is directed towards the natural gas distribution network. A certain quantity of crude gas, drawn off at the boiler outlet 76, is directed towards the compressor 53 and through the tube 54, which is divided into six tubes 55 provided with their valves 56 for introducing short pressurized blasts into the tuyeres 24, each time evacuation is stopped in one compartment at a time in order to unclog the filters and to loosen the ash in the compartment concerned.

The three production block diagrams shown in FIGS. 5, 6 and 7 show that the different gases produced leaving the gas generator may be used directly, as they are, without the need for a purification and recovery outfit downstrean of the reactor. Similarly, the coal loaded may be of any size or of an composition. Even if it is rich in sulphur-containing products, it is sufficient to load a quantity of calcium-containing substance in order that the flow in cocurrent motion promotes the reaction of the sulphur with the calcium-containing substance and enables it to be cleared with the ash.

The thermal shock which the coal undergoes as soon as it is introduced into the reactor makes it burst, volatilizes the volatile substances and decomposes them so that they are converted into useful gas. Therefore, there are no harmful by-products in the gas produced.

The cocurrent and high temperature reaction avoids all the caking problems which are inherent in the processes which comprise at least one initial countercurrent reaction phase. Moreover, the final countercurrent phase of the present invention completes the reaction of the residual carbon in the ash and, at the same time, ensures the cooling of the ash, with total heat recovery in the reactor.

Additionally, the gas generator according to the invention has considerable economic advantages. It consists of a single vertical vessel. As it is operated under pressure, its volumes is reduced, the gases are compressed before the increase in volume due to the reaction in the gas generator, the net energy yield is very high and its fluid and energy requirements are very limited. If it is compared, for example, with the LURGI reactor, which is in wide-spread use, it is observed that there is no need to regulate the exothermic combustion reaction, as is done in the LURGI process by injecting steam. This represents an absolute loss of energy, which does not occur in the present process. Additionally, the LURGI process requires the choice of a size-graded coal with non-caking properties and which is low in sulphur-containing products. Despite these rigorous requirements with regard to fuel quality, the LURGI process must provide an enormous dynamic crushing-grinding arm to ensure a certain uniform downward movement of the fixed bed. In contrast, in the gas generator of the present invention, the static compartmentation of the lower part of the gas generator and the regulation of the rate of gas evacuation and ash clearing described above ensure a homogeneous distribution and a uniform downward movement, without problem, of the fixed bed mass.

Finally, a not insignificant economic factor which consists in the freedom to use less expensive coal from any source, with no restrictions with regard to either its physical (particle size) or chemical (caking capacity and sulphur content) properties must be added. All these factors make it possible to manufacture purified gases at low cost which meet the most recent antipollution regulations.

I claim:

1. A process for the gasification of coal in a fixed bed by reaction with a reactive gas under pressure in a sealed vertical generator, a lower part of which is divided into at least three compartments by means of vertical partitions, each of said compartments having a gaseous products outlet means and an opening for the removal of ash, comprising the steps of:

loading the coal into an upper region of the generator and distributing it to form a fixed bed of coal therein;

introducing a reactive gas into the generator at a first level, close to the point of loading of the coal, at a temperature close to the fusion temperature of ash produced in the process and under a pressure of at least 2 bars (0.2 MPa), thus subjecting the coal to a thermal shock soon after its loading into the generator;

introducing additional reactive gas into the generator at at least one level below the first level, a major part of the total quantity of reactive gas introduced into the generator being introduced at the first level;

flowing the reactive gases introduced into the generator at the first level and the at least one level below the first level downwardly through the fixed bed of coal to gasify the coal and produce gaseous products and ash which move downwardly through the generator and into the compartments;

evacuating the gaseous products from the generator through the outlet means of each of the compartments except for one, and adjusting the rate of evacuation of the gaseous products therefrom so as to be identical for each of the compartments independently of irregular permeability of the bed;

removing a defined quantity of ash which is identical for each of the compartments, through the opening for the removal of ash from said one compartment while blowing cold reactive gas through the opening and into said one compartment for completing the gasification of residual carbon in the ash and cooling the ash; and sequentially changing the one compartment from which ash is is removed while the gaseous products are evacuated through each of the compartments except for the one compartment, for removing ash from each compartment of said compartments in turn.

2. A process according to claim 1 wherein each gaseous outlet means includes a filter, and further comprising:

blowing cold gas produced by the process, steam, or a mixture thereof, briefly and vigorously through the gaseous products outlet means of said one compartment from which ash is being removed, in a direction opposite to that of gaseous products evacuation for cleaning the filter.

3. A process according to claim 2, further comprising adding a calcium-or magnesium-containing substance to the coal for gasification.

4. A process according to claim 1, further comprising adding a calcium-or magnesium-containing substance to the coal for gasification.

5. A method for removing ash from a vertical fixed bed generator for gasifying coal in which the coal is introduced at the top and flows downwardly under gravity for reaction with a reactive gas to produce gaseous products and ash, and in which gas flows downwardly through the generator, comprising the steps of:

dividing a lower portion of the generator with a plurality of vertical partitions into a plurality of radially distributed compartments;

evacuating gaseous products from each of the compartments;

intermittently discontinuing the evacuation of gaseous products from each of the compartments sequentially; and while evacuation of the gaseous products from each said compartment is discontinued, removing ash from said compartment.

6. A method as recited in claim 5, further comprising removing identical quantities of ash from each of said compartments for promoting uniform downward flow of the coal.

7. A method as recited in claim 5, further comprising blowing cold reactive gas into each said compartment during removal of ash therefrom for gasification of any residual carbon in the ash and cooling the ash.

8. A method as recited in claim 5, further comprising briefly blowing a gas into each said compartment in a direction opposite to the direction of evacuation of gaseous products for loosening ash in said compartment while evacuation of gaseous products from each said compartment is discontinued.

9. A method as recited in claim 5, further comprising evacuating identical quantities of gaseous products from each said compartment except any compartment from which evacuation of gaseous products is discontinued for removal of ash.

10. A method as recited in claim 5, further comprising filtering gaseous products evacuated from each said compartment with a means for filtering adjacent to the compartment, and while evacuation of gaseous products from each said compartment is discontinued, briefly blowing a gas through the means for filtering and into the compartment in a direction opposite to the direction of evacuation of gaseous products for cleaning the means for filtering.

* * * * *